US006817880B2

(12) United States Patent
Pezzetta

(10) Patent No.: US 6,817,880 B2
(45) Date of Patent: Nov. 16, 2004

(54) METHOD OF CONNECTING ELECTRICAL CONNECTORS AND A CONNECTION MODULE ADAPTED TO IMPLEMENT THE METHOD

(75) Inventor: Aldo Pezzetta, Mareil Marly (FR)

(73) Assignee: Dassault Aviation, Paris (FR)

( * ) Notice: Subject to any disclaimer, the term of this patent is extended or adjusted under 35 U.S.C. 154(b) by 0 days.

(21) Appl. No.: 10/413,368

(22) Filed: Apr. 15, 2003

(65) Prior Publication Data

US 2003/0199190 A1 Oct. 23, 2003

(30) Foreign Application Priority Data

Apr. 18, 2002 (FR) ..... 02 04854

(51) Int. Cl.[7] ..... H01R 13/62
(52) U.S. Cl. ..... 439/341; 439/367; 439/376
(58) Field of Search ..... 439/64, 326, 333, 439/342, 367, 372, 374, 376, 377, 378, 261, 341

(56) References Cited

U.S. PATENT DOCUMENTS 4,534,608 A 8/1985 Scott et al.
5,510,957 A * 4/1996 Takagi ..... 361/814
5,607,319 A * 3/1997 Wakata et al. ..... 439/341
5,966,023 A * 10/1999 Burgers et al. ..... 324/761
6,217,360 B1 * 4/2001 Parent ..... 439/341
6,244,888 B1 * 6/2001 Cappe ..... 439/341
6,561,835 B1 * 5/2003 Hirschberg et al. ..... 439/362

FOREIGN PATENT DOCUMENTS

DE 86 27 007.9 3/1987
EP 0 599 362 6/1994

* cited by examiner

*Primary Examiner*—P. Austin Bradley
*Assistant Examiner*—James R. Harvey
(74) *Attorney, Agent, or Firm*—Jacobson Holman PLLC

(57) ABSTRACT

A method is disclosed of connecting first and second electrical connectors each having a plurality of aligned straight pins complementary to corresponding pins of the other connector, the pins of each pair of complementary pins being designed to engage coaxially one within the other. Free ends of the pins of the first and second connectors are placed in two intersecting planes so that the pins of the two connectors have axes that lie in a common plane perpendicular to the intersection of the planes, the axes of the pins of the pairs of complementary pins being equidistant from the intersection. One connector is then pivoted relative to the other about the intersection to align the pins of each pair of complementary pins on a common axis. The complementary pins are then engaged one within the other by movement of one connector toward the other in translation in a direction parallel to the aligned axes of the pins.

17 Claims, 2 Drawing Sheets

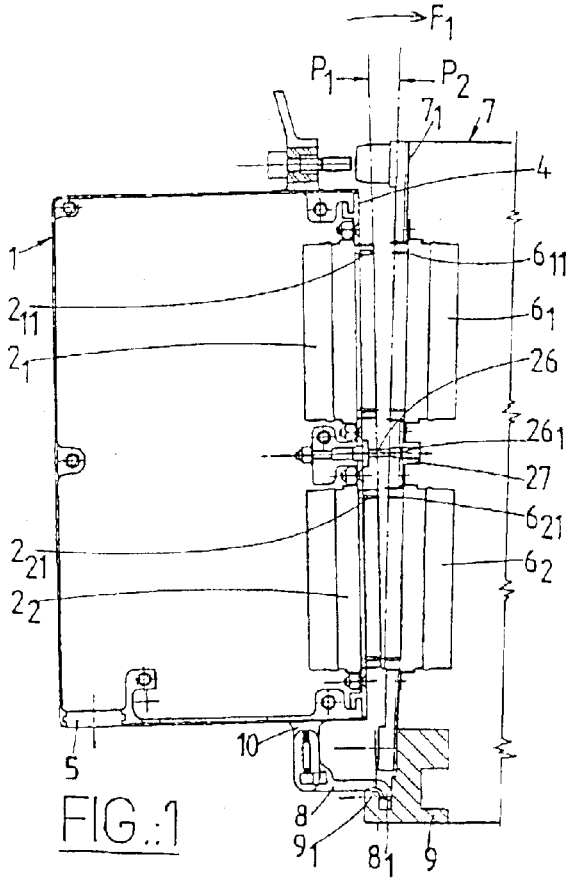
FIG.:1
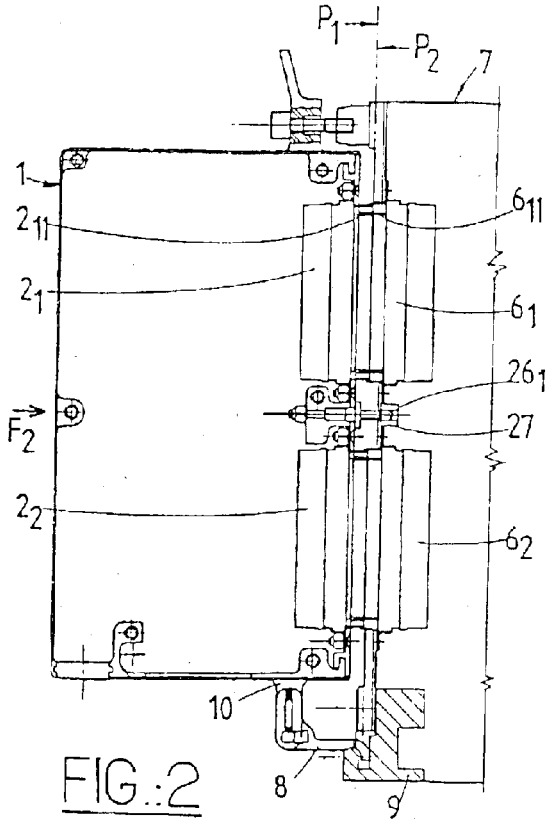
FIG.:2
FIG.:3
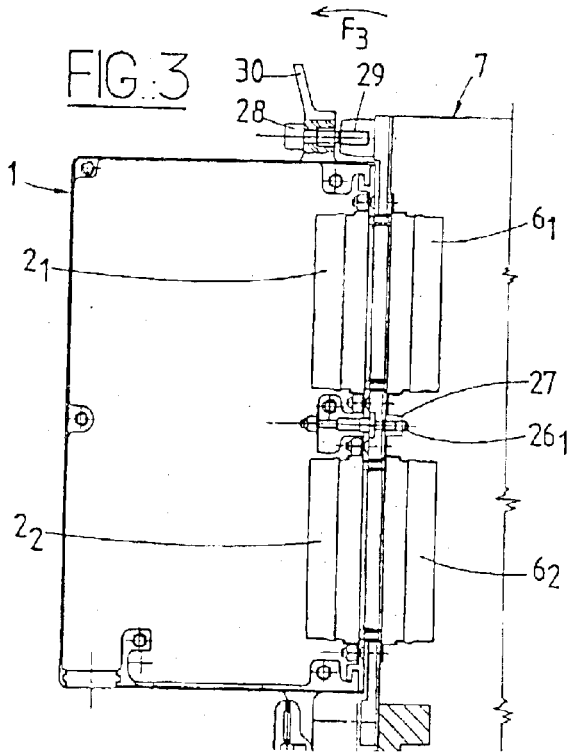

METHOD OF CONNECTING ELECTRICAL CONNECTORS AND A CONNECTION MODULE ADAPTED TO IMPLEMENT THE METHOD

BACKGROUND OF THE INVENTION

1. Field of the Invention

The present invention relates to a method of connecting electrical connectors and a connection module adapted to implement the method.

2. Description of the Prior Art

FIG. 1 of the appended drawings shows a prior art connection module 1. The module 1 can include one or more connectors $\mathbf{2}_i$, for example two connectors $\mathbf{2}_1$ and $\mathbf{2}_2$ as shown here. Each of the connectors $\mathbf{2}_1$, $\mathbf{2}_2$ includes a plurality of male or female connecting pins $\mathbf{2}_{1j}$, $\mathbf{2}_{2j}$, respectively, and the pins are straight and aligned in one row or in parallel rows.

The connectors $\mathbf{2}_i$ are mounted in alignment on the module 1 so that the pins $\mathbf{2}_{ij}$ project from a lateral face 4 of the module. The pins are connected inside the module to electrical wires or cables (not shown) that emerge from the module in a bundle via one or more openings 5.

Thus the connectors $\mathbf{2}_1$, $\mathbf{2}_2$ are adapted to be connected to associated and complementary connectors $\mathbf{6}_1$, $\mathbf{6}_2$ correspondingly mounted on an electrical or electronic device 7, to be more precise on a face $\mathbf{7}_1$ of an enclosure of the device, which is itself connected to the connectors $\mathbf{6}_1$, $\mathbf{6}_2$. The pins $\mathbf{6}_{1j}$, $\mathbf{6}_{2j}$ of these connectors are each complementary to one of the pins $\mathbf{2}_{1j}$ and $\mathbf{2}_{2j}$ of the respective connectors $\mathbf{2}_1$, $\mathbf{2}_2$.

Thus electrical currents or signals can flow between the wires or cables connected to the connectors $\mathbf{2}_1$, $\mathbf{2}_2$ and the electrical and/or electronic device.

The module 1 is conventionally attached to a lug 8 having a rounded end $\mathbf{8}_1$ shaped to hook onto and pivot on a rim $\mathbf{9}_1$ of a support bar 9 fastened to the face $\mathbf{7}_1$ of the device 7 that carries the complementary connectors $\mathbf{6}_1$, $\mathbf{6}_2$. The rim $\mathbf{9}_1$ therefore defines a rotation axis for the module 1 when the lug 8 of the latter is bearing on the rim.

A raised portion and a corresponding notch are formed on the lug 8 and on the rim $\mathbf{9}_1$, respectively, to define a position of the module 1 registering with that of the connectors $\mathbf{6}_1$, $\mathbf{6}_2$ of the device 7 in a direction transverse to the axis of the rim $\mathbf{9}_1$.

To connect the connectors $\mathbf{2}_1$, $\mathbf{2}_2$ to the corresponding connectors $\mathbf{6}_1$, $\mathbf{6}_2$, the lug 8 on the module 1 is hooked onto the support bar 9. Thus in the starting position the module 1 and the connectors $\mathbf{2}_1$, $\mathbf{2}_2$ are inclined so that the rows of pins of the connectors are in the same plane, parallel to that of the figure, as the corresponding complementary pins of the connectors $\mathbf{6}_1$, $\mathbf{6}_2$. The pins of any pair of complementary pins (consisting of a male pin and a female pin that must engage one over the other) are equidistant from the rotation axis defined by the end $\mathbf{8}_1$ of the lug 8 bearing on the rim $\mathbf{9}_1$.

Starting from this inclined position of the module 1, the latter is rotated (in the direction of the arrow F1) to move the pins $\mathbf{2}_{1j}$, $\mathbf{2}_{2j}$ of the connectors $\mathbf{2}_1$, $\mathbf{2}_2$ toward the corresponding pins $\mathbf{6}_{1j}$, $\mathbf{6}_{2j}$ of the connectors $\mathbf{6}_1$, $\mathbf{6}_2$, respectively, and then to engage the female (for example) pins $\mathbf{2}_{1j}$, $\mathbf{2}_{2j}$ over the corresponding male pins $\mathbf{6}_{1j}$, $\mathbf{6}_{2j}$ to the full length of the pins, as shown in FIG. 1.

Because all the corresponding male and female pins are straight, they are designed to be normally engaged with each other coaxially.

During the rotation movement described above, from the moment at which the female pins of the connectors $\mathbf{2}_1$, $\mathbf{2}_2$ begin to engage over the corresponding male pins of the connectors $\mathbf{6}_1$, $\mathbf{6}_2$, the axis of each female pin $\mathbf{2}_{ij}$ turns tangentially to a circular path and remains inclined to that of the corresponding male pin until the moment at which the female pin is completely engaged over the whole length of the corresponding male pin $\mathbf{6}_{ij}$, at which point these axes are finally colinear.

The non-colinearity of these axes throughout the engagement of the corresponding pairs of pins one over the other has a harmful consequence: the transmission, between the pins of each pair of pins brought into contact, of bending stresses likely, eventually, to damage them mechanically. This can lead to breakdown in the transmission of power or signals and therefore to degraded operation of the devices connected by such connectors or even complete failure thereof.

An object of the present invention is precisely to provide a method of connecting electrical connectors designed to protect them from this kind of damage.

Another object of the present invention is to provide a connection module adapted to implement the method.

SUMMARY OF THE INVENTION

The above objects of the invention, together with others that will become apparent on reading the description given hereinafter, are achieved by a method of connecting first and second electrical connectors each having a plurality of aligned straight pins complementary to corresponding pins of the other connector, the pins of each pair of complementary pins being designed to engage coaxially one within the other, in which method:

a) free ends of said pins of said first and second connectors are placed in two intersecting planes so that said pins of said two connectors have axes that lie in a common plane perpendicular to the intersection of said planes, said axes of said pins of said pairs of complementary pins being equidistant from said intersection, b) one connector is pivoted relative to the other about said intersection to align said pins of each pair of complementary pins on a common axis, and c) said complementary pins are engaged one within the other by movement of one connector toward the other in translation in a direction parallel to the aligned axes of said pins.

As explained in more detail later, the invention totally eliminates the transmission of bending forces between two pins during their mutual engagement, and thus all risk of deformation thereof by such bending forces. This achieves more reliable operation of devices equipped with this kind of connector, which is particularly beneficial in the aerospace industry, for example.

The present invention also provides a connection module for implementing the above method, the module including the first connector and the second connector being fastened to an electrical or electronic device equipped with a support bar for supporting a lug projecting from the module, rotation of the module between respective positions away from and close to the first and second connectors being guided by the bar, in which connection module the lug can move in translation on the module in a direction parallel to the axes of the pins of the first connector between first and second positions firstly to enable pivoting of the module when in the first position to align the pins of each pair of complementary pins of the connectors on a common axis and secondly to guide coaxial engagement of the complementary pins one within the other when it moves to its second position when the module is pushed in a direction parallel to the axes of the pins to bring about such engagement.

According to other features of the present invention:

the lug is mounted on the module by means of a stud and slot connection, the slot is parallel to the axes of the pins of the connector carried by the module, and the first and second positions of the lug are defined by contact between the stud and first and second ends of the slot, respectively, the module includes a latch for immobilizing the lug in its second position and consisting of an elastic blade mounted on the lug, which is in turn mounted on an extension of the module, and having a lip engaging against a stop formed in the extension to immobilize the lug in its second position, and the module includes means for unlocking the latch, including firstly a detent in the profile of the slot enabling the stud to rotate through a small angle in the slot when it is in contact with the second end of the slot and secondly a finger fastened to the extension and such that the rotation through a small angle moves the finger against the blade to disengage the lip from the blade of the stop.

Other features and advantages of the present invention will become apparent on reading the following description and referring to the appended drawings.

BRIEF DESCRIPTION OF THE DRAWINGS

FIG. 1 is a view in section of a connection module in accordance with the present invention, at an initial phase of a connection method according to the invention, and has already been described in part in the preamble to this description.

FIGS. 2 and 3 are views in section analogous to that of FIG. 1, showing two successive steps of a connection method according to the invention.

DETAILED DESCRIPTION OF THE PREFERRED EMBODIMENT

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The description of a connection module in accordance with the invention continues with reference to FIGS. 1 to 4 of the appended drawings. The prior art features of the module have already been described in the preamble to this description.

Figure 4:
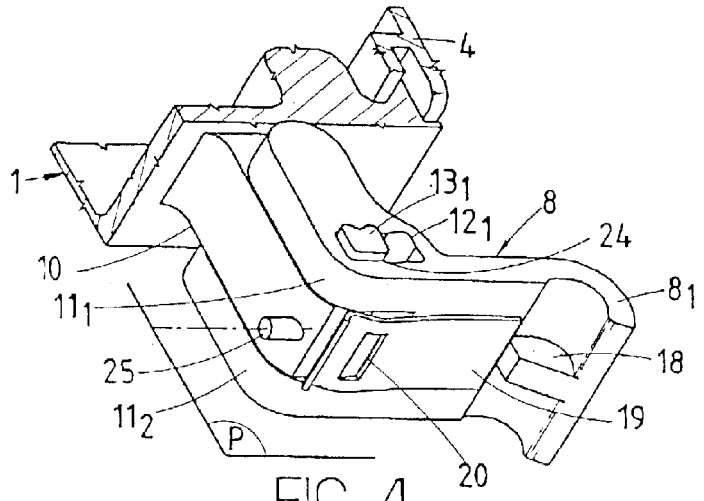
FIG. 4 is a perspective view of a portion of the module shown in FIGS. 1 to 3, showing the mounting of a lug for installing the module on a support bar.

According to the present invention, the lug 8, which in the prior art is mounted rigidly on the module 1, is mobile in translation on an extension 10 of the module 1, by virtue of at least one stud and slot connection, as seen most clearly in FIG. 4. In that figure it is apparent that the lug 8 is substantially symmetrical with respect to a median plane P and includes two cranked arms $\mathbf{11}_1$, $\mathbf{11}_2$ with respective slots $\mathbf{12}_1$, $\mathbf{12}_2$ at the corner of an arm, through which passes a respective stud $\mathbf{13}_1$, $\mathbf{13}_2$ fastened to the extension, from which it projects laterally (in FIG. 4 only the slot $\mathbf{12}_1$ and the stud $\mathbf{13}_1$ are visible).

The arms $\mathbf{11}_1$, $\mathbf{11}_2$ lie one on each side of the extension 10. The axes of the slots are parallel to the axes of the studs of the connectors $\mathbf{2}_1$, $\mathbf{2}_2$ carried by the face 4 of the module 1. The length of the slots $\mathbf{12}_1$, $\mathbf{12}_2$ is substantially twice the width of the studs $\mathbf{13}_1$, $\mathbf{13}_2$ in the direction of the axis of the slots. The cross sections of the studs are substantially square with a side length substantially equal to the width of the slots.

Figure 5:
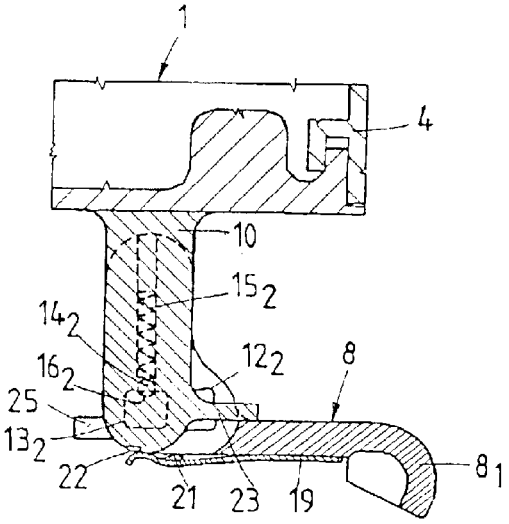
FIGS. 5, 6 and 7 are views of the FIG. 4 lug in section in three different positions.
Figure 6:
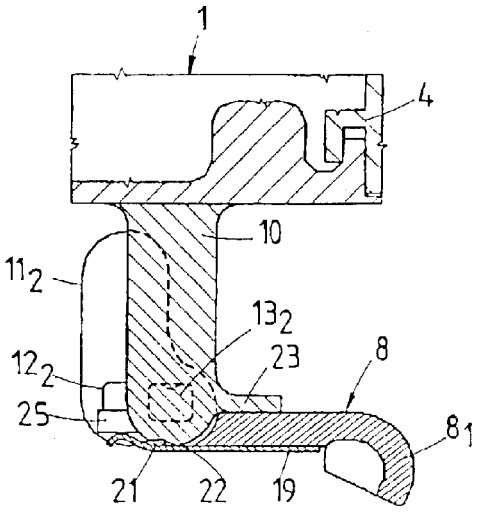

It is therefore clear that the lug 8 can move on the extension 10 between first and second positions shown in FIGS. 5 and 6, respectively, which show the extension 10 and the lug 8 in section in the median plane P of the lug. These positions are defined by the studs $\mathbf{13}_1$, $\mathbf{13}_2$ abutting against the left-hand and right-hand ends of the slots $\mathbf{12}_1$, $\mathbf{12}_2$, respectively.

The lug 8 can be immobilized temporarily in its first position (that shown in FIG. 5) by retaining spring means incorporated into the portions of the cranked arms $\mathbf{11}_1$, $\mathbf{11}_2$ that are parallel to the extension 10. FIG. 5 shows in chain-dotted outline one of the retaining means, consisting of a ball $\mathbf{14}_2$ spring-loaded by a spring $\mathbf{15}_2$ towards a notch $\mathbf{16}_2$ formed in the stud $\mathbf{13}_2$ that passes through the arm $\mathbf{11}_2$.

In the rounded end portion $\mathbf{8}_1$ of the lug 8 (see FIG. 4) there is a raised portion 18 shaped to engage in a complementary housing in the support bar 9. The raised portion and the housing ensure precise axial location of the connection module 1 on the bar 9 such that the corresponding pins of the connectors $\mathbf{2}_1$, $\mathbf{2}_2$ and $\mathbf{6}_1$, $\mathbf{6}_2$ are in a common plane perpendicular to the axis of the bar 9.

FIG. 4 also shows the presence on the lug 8 of a latch for immobilizing the lug in its second position. The latch takes the form of an elastic blade 19 fixed at one end to said lug and punched at 20 at its other end to form a lip 21 out of the plane of the blade, as shown in FIG. 6. In this figure, which shows the lug 8 in its second position, it is apparent that the lip 21 is at this time engaged against a stop 22 formed at the rounded end of the extension 10 of the module, to prevent the lug 8 moving back to its first position.

Figure 7:
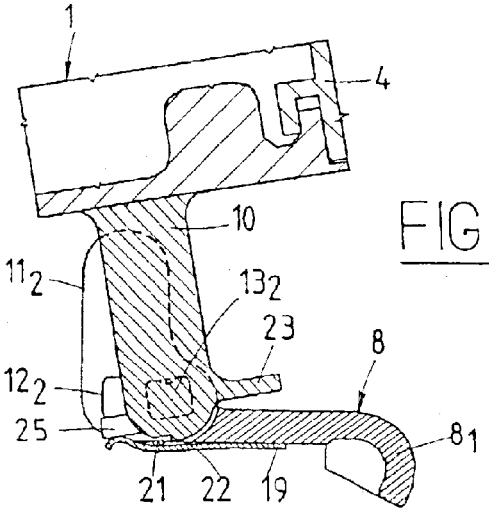

Note in FIGS. 5 to 7 the presence of a tongue 23 projecting perpendicularly from the extension 10 and bearing on the lug 8. The tongue 23 opposes a rotation torque developed by the elastic blade 19, because of the necessary clearance between the lugs, such as the stud $\mathbf{13}_1$, and the corresponding slots, to prevent the lug 8 from rotating in the counterclockwise direction (as seen in FIG. 6).

In FIG. 4, it is further apparent that the lower edge of the slot $\mathbf{12}_1$ has a recessed detent 24 adapted to allow slight rotation of the stud $\mathbf{13}_1$ in the counterclockwise direction in the slot $\mathbf{12}_1$ when the lug 8 is in its second position.

This rotation is shown in FIG. 7, where it is greatly exaggerated to clarify the drawing. It brings a finger 25 fastened to the end of the extension 10 into contact with one end of the elastic blade 19, the finger then disengaging the lip 21 from the stop 22 to allow the lug to return to its first position (see below).

A connection method in accordance with the invention is described next, primarily with reference to FIGS. 1 to 3.

To connect the connectors $\mathbf{2}_1$, $\mathbf{2}_2$ of the module 1 to the complementary connectors $\mathbf{6}_1$, $\mathbf{6}_2$ of the device 7, first of all a free end $8_1$ of the lug 8 on the module is hooked onto the support bar 9 with the lug in its first position (see FIG. 5) and the raised portion 18 of the lug located in the housing provided on the bar to receive it (see FIG. 4)

The lug 8 has dimensions such that the plane $P_1$ passing through the free ends of the pins $2_{1j}$, $2_{2j}$ of the respective connectors $2_1$, $2_2$ of the module (see FIG. 1) intersects the plane $P_2$ that passes through the free end of the pins $6_{1j}$, $6_{2j}$ of the respective connectors $6_1$, $6_2$ of the device 7, on the rotation axis of the module, as defined by the rounded end of the lug 8 and the rim $9_1$ of the bar 9 on which the lug bears.

The corresponding pins (female on one side, male on the other) of the connectors $2_1$, $2_2$ and $6_1$, $6_2$ being equidistant from this axis, it is clear that rotation of the module 1 in the direction of the arrow $F_1$ in FIG. 1 lines up the corresponding pins, end to end, on a common axis, with the planes $P_1$ and $P_2$ coincident (see FIG. 2).

It is clear that from this position the corresponding pins can be engaged one within the other by pushing the module 1 in the direction of the arrow $F_2$ in FIG. 2, parallel to the aligned axes of the pins arranged end to end. This moves the module in translation in the direction of the arrow $F_2$.

This movement in translation is possible because pushing the module causes the lug 8, whose free end $8_1$ abuts on the bar 9 in the FIG. 1 position, to expel the ball $14_2$, which normally retains it in its first position (see FIG. 5), and then move to its second position (see FIGS. 3 and 6).

The lug 8 is then held in its second position by the clipping action of the lip 21 and the recessed stop 22 in the extension 10.

During the succession of movements of the module from the FIG. 1 position to the FIG. 3 position, a guide 26 fastened to the module and fixed between the connectors $2_1$, $2_2$ is progressively inserted into a complementary housing 27 to the rear of the face 71 of the device 7, between the connectors $6_1$ and $6_2$. The end $26_1$ of the guide 26 is shaped to fit only into the housing 27, because they have complementary cross sections.

The guide 26 and the housing 27 therefore act as a polarizer, to prevent connection of the connectors $2_1$, $2_2$ to connectors $6_1$, $6_2$ other than those to which they should be connected.

When the module 1 is in its final connection position (FIG. 3), it is fixed to the device 7 by tightening a screw 28 in a complementary screwthread 29 on the device 7. The screw 28 is near a tab 30 at an end of the module opposite that which hooks onto the bar 29.

To demount the module 1 from the device 7, the screw 28 is unscrewed and the module 1 is pulled in the direction of the arrow $F_3$ in FIG. 3 to disengage it from the connectors $6_1$, $6_2$.

The lug 8 is then disengaged from the support bar 9 to separate the module 1 completely from the device 7.

The lug 8 is then turned by hand through a small angle about the axis of the studs $13_1$, $13_2$, which is allowed by the detent 24. The fingers 25 are then in the position shown in FIG. 7, where they disengage the lip 21 from the stop 22, enabling the lug 8 to be returned to its first position manually.

It is now apparent that the invention achieves the stated object, namely to ensure coaxial engagement of the pins of complementary connectors one within the other without applying bending forces likely to damage them. This improves the durability and reliability of the equipment concerned, which is particularly desirable in aerospace applications.

Of course, the invention is not limited to the embodiment described and shown, which is provided by way of example only.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A method of connecting first and second electrical connectors each having a plurality of aligned straight pins complementary to corresponding pins of the other connector, the pins of each pair of complementary pins being designed to engage coaxially one within the other, said method comprising the steps of:

a) hooking said first connector to said second connector with an extension having a component that is mobile in translation thereon, said extension being stationarily fixed with said first connector so that a first plane passing through the free ends of said pins of said first connector intersects a second plane passing through the free ends of said pine of said second connector at a rotation axis thereby formed between said connectors, said pine of said two connectors having axes that lie in a common plane generally perpendicular to the intersection of said first and second planes, said axes of said pins of said pairs of complementary pins being equidistant from said intersection;

b) pivoting one connector relative to the other about said intersection to align said pins of each pair of complementary pins on a common axis, said first and second planes being coincident; and c) engaging said complementary pins one within the other by movement of one connector toward the other in translation in a direction parallel to the common axes of said pins as aligned.

2. A connection module for implementing a method of connecting two electrical connectors, each having a plurality of aligned straight pins complementary to corresponding pins of the other connector, by placing free ends of the pins of the two connectors in two intersecting planes so that the pins have axes that lie in a common plane generally perpendicular to the intersection of the planes and the axes of pairs of complementary pins are equidistant from the intersection, pivoting one connector relative to the other about the intersection to align the pins of each pair of complementary pins on a common axis, and engaging the complementary pine one within the other by movement of one connector toward the other in translation in a direction parallel to the aligned axes of the pins, said module comprising:

a first connector and a second connector fastened to an electrical or electronic device equipped with a support bar for supporting a lug projecting from said module, rotation of said module between respective positions away from and close to said first and second connectors being guided by said bar, in which connection module said lug can move in translation on said module in a direction parallel to said axes of said pins of said first connector between first and second positions firstly to enable pivoting of said module when in said first position to align said pins of each pair of complementary pins of said connectors on said common axis and secondly to guide coaxial engagement of said complementary pins one within the other when moved to said second position when at least one of said connectors is pushed in a direction parallel to said axes of said pins to bring about such engagement.

3. The module claimed in claim 2 wherein said lug is mounted on said module by means of a stud and slot connection, said slot is parallel to said axes of said pins of said connector carried by said module, and said first and second positions of said lug are defined by contact between said stud and first and second ends of said slot, respectively.

4. The module claimed in claim 3, further including a latch having an elastic blade mounted on said lug, which is in turn mounted on an extension of said module, and having a lip engaging against a stop formed in said extension to immobilize said lug in said second position.

5. The module claimed in claim 4, further including a detent in the profile of said slot enabling said stud to rotate through a small angle in said slot when said stud is in contact with said second end of said slot, and a finger fastened to said extension such that said rotation through a small angle moves said finger against said blade to disengage said lip from said blade of said stop to unlock said latch.

6. The module claimed in claim 4, wherein a tongue projects from said extension to immobilize said lug by opposing a rotation torque applied to said lug by said elastic blade.

7. The module claimed in claim 3, further including a spring mechanism for retaining said stud in contact with said first end of said slot when said lug is in said first position.

8. The module claimed in claim 3, further including a polarizer guide shaped to engage in a complementary and corresponding housing in said device when said module is installed thereon.

9. A connection module for connecting an electrical connector to a complementary electrical connector on an electrical or electronic device, said connection module comprising:

a first connector having a plurality of aligned straight pins complementary to corresponding pins of a second connector mounted to said device, the pins of each pair of complementary pins being designed to engage coaxially one within the other, a lug projecting from said module and supported on a support bar on said electrical or electronic device such that said module is pivotable on said support bar to bring said first and second connectors closer to or further apart from one another for alignment of said pins of said first and second connectors;

said lug being movable in translation on said module in a direction substantially parallel to an axis of said pins of said first connector between a first position and a second position, said first position enabling the pivoting of said module on said support bar to align each pair of complementary pins of said first and second connectors on a common axis, and movement of said lug to said second position guiding coaxial engagement of said complementary pins one within the other when said module is pushed in a direction parallel to said common axis to bring about such engagement.

10. The connection module claimed in claim 9 wherein said lug is mounted on said module by means of a stud and slot connection, said slot being parallel to said axis of said pins of said first connector, and said first and second positions of said lug being defined by contact between said stud and first and second ends of said slot, respectively.

11. The connection module claimed in claim 10, further including a latch for immobilizing said lug in said second position and including an elastic blade mounted on said lug, which is in turn mounted on an extension of said module and has a lip engaging against a stop formed in said extension.

12. The connection module claimed in claim 11, further including a detent in the profile of said slot enabling said stud to rotate through a small angle in said slot when said stud is in contact with said second end of said slot, and a finger fastened to said extension such that said rotation through a small angle moves said finger against said blade to disengage said lip from said blade of said stop to unlock the latch.

13. The connection module claimed in claim 11, wherein a tongue projects from said extension to immobilize said lug by opposing a rotation torque applied to said lug by said elastic blade.

14. The connection module claimed in claim 10, further including a spring mechanism for retaining said stud in contact with said first end of said slot when said lug is in said first position.

15. The connection module claimed in claim 10, further including a polarizer guide shaped to engage in a complementary and corresponding housing in said device when said module is installed thereon.

16. The method as claimed in claim 1, wherein in said step of engaging, said movement of one connector toward another engages a latch mechanism to immobilize said connectors upon engagement of said pins.

17. The method as claimed in claim 16, wherein said first connector is the one connector that is moved, said first connector including a lug mounted by means of a stud and slot connection for effecting said movement in translation, said method further including rotating said stud within said slot to disengage said latch mechanism and allow disengagement of said pins.

* * * * *

UNITED STATES PATENT AND TRADEMARK OFFICE

CERTIFICATE OF CORRECTION

PATENT NO. : 6,817,880 B2
APPLICATION NO. : 10/413368
DATED : November 16, 2004
INVENTOR(S) : Aldo Pezzetta It is certified that error appears in the above-identified patent and that said Letters Patent is hereby corrected as shown below:

Claim 1 in Col. 6, at line 23, change "pine" to --pins--;

at line 25, change "pine" to --pins--; and

Claim 2 in Col. 6, at line 50, change "pine" to --pins--.

Signed and Sealed this

Twenty-fifth Day of July, 2006

JON W. DUDAS
*Director of the United States Patent and Trademark Office*